US005603676A

United States Patent [19]

Cymbalisty

[11] Patent Number: 5,603,676

[45] Date of Patent: Feb. 18, 1997

[54] CRAWL SWIM EXERCISER

[76] Inventor: Kenneth J. Cymbalisty, Menlo Park Branch US Hwy No. 1 & Parsonage Rd., Menlo Park, N.J. 08837

[21] Appl. No.: 622,453

[22] Filed: Mar. 22, 1996

[51] Int. Cl.[6] ..... A63B 69/10

[52] U.S. Cl. ..... 482/56; 482/96; 482/129; 482/143

[58] Field of Search ..... 482/51, 55, 56, 482/66, 69, 72, 95, 96, 143; 434/254

[56] References Cited

U.S. PATENT DOCUMENTS

| | | | |
|---|---|---|---|
| 242,073 | 5/1881 | Terry | 482/72 |
| 2,434,542 | 1/1948 | Burroughs | 482/55 X |
| 5,354,251 | 10/1994 | Sleamaker | 482/96 |

FOREIGN PATENT DOCUMENTS

| | | | |
|---|---|---|---|
| 1443905 | 12/1988 | U.S.S.R. | 434/254 |

*Primary Examiner*—Richard J. Apley

*Assistant Examiner*—John Mulcahy

*Attorney, Agent, or Firm*—William T. Hough, Esq.

[57] ABSTRACT

A crawl swim exerciser includes a substantially horizontal elevated beam supported on and between spaced-apart head and foot supports, supported above a supporting substrate supportable of lower ends of the head and foot supports, with a roller mechanism being supported on and rollable along the elevated beam. Supported on the roller mechanism and slung below the beam is a support harness positioned to intermittently suspend a person's horizontally-positioned body lengthwise in a swim-position substantially lengthwise parallel with the beam while leaving legs and arms of a suspended person substantially free for making swimming leg kicks and swimming arm strokes. Paired opposite horizontally pivotal spring-biased arms are supportedly mounted near the head, each being spring-biased substantially forwardly away from the foot supports and having respectively one of a pair of spaced-apart left and right hand-graspable grips for grasping, one with a symbolic swimmer's opposite left and right hands respectively such that resistance to swimming-like strokes simmulate water resistance normally encounted during actual swimming.

8 Claims, 4 Drawing Sheets

44
45
46
47
48
20
50
51
52
53
54
40
41
42
43
29
30
31
32
33
34
35
36
37
38
39
49

CRAWL SWIM EXERCISER

BACKGROUND OF THE INVENTION

This invention relates to a device for exercising a user's arms and torso as they move to simulate the correct crawl stroke motion and in particular to such a device in which the user is suspended in a horizontal orientation so that no apparatus or body support structure can interfere with the arms executing a correct crawl swim motion.

Many people do not swim well because of flaws in their swimming movements. Crawl swimming, when performed correctly, requires movements which are a little awkward and unnatural. This is because a swimmer is not merely swinging his arms in any haphazard manner. He should be striving, stroke after stroke, to maintain as streamlined a body form as possible while positioning his hands so that he will get the maximum straight back thrust possible. Maximum thrust is achieved when a swimmer starts his hand push back with the proper form to smoothly glide the pushing hand with his elbow bent at 90°, which is the optimum thrust producing angle.

There are other swimming machines on the market but the instant invention is the first and only offering unrestricted freedom to move the hands, arms, shoulders, torso and legs in a perfect crawl stroke form. One's movements can be carefully and accurately manipulated while suspended and lying flat on the belly with no obstructions to interfere with a 90° bent elbow across the chest arm motion. Those dry land swim training machines where support for the body comes from below, rather than above as in the Orcan Swimee, have that support as an interferance.

SUMMARY OF THE INVENTION

The present invention overcomes the shortcomings and limitations of prior swim exercise machines by providing, in a preferred embodiment, a swimming simulator which positions the user in a suspended, face down, horizontal position while connected to a movable trolley (beam roller housing). The trolley rides on a long beam which can have its angle adjusted to vary the arm resistance encountered in the propulsion foward of that trolley. The two swinging arm bases are also adjustable to accommodate the adjustment of the long beam.

The foward propulsion is created when the suspended user pulls (via handholds) flexible rubber stretch cords which are connected to horizontally pivoting arms, which afford additional resistance because they are connected (via springs) to an advantageous point of the structure. Gravity brings the trolley backward enough to initiate alternating foward propulsions.

The suspended cradle, on which a person positions, his torso face down, should be constructed so that its contours conform with and compliment a person's body so as to be comfortable. The connection of the cradle, via strong and flexible straps, to the trolley positions it at a sufficient hang depth so it can accommodate most average weight people. The straps, which wrap around underneath the cradle, should be connected to a part of the trolley whereby they can be at a sufficient width apart to accommodate entry, exit and comfortable propulsive activities. The straps should hold the cradle so that the person operating the swim trainer will ride parallel to the long beam on which the trolley rides. One gets on the cradle by crawling in from the rear while grasping the front of the cradle and pushing with his legs.

The arms, from which flexible cords with handholds are secured, are supplied strong resistance by being connected (via springs) to an upright support located ahead at the very top or front of the machine. The springs and the flexible cords are connected to approximately the same area of the swinging arm. The cords, on which the user pulls, have a further allowance for movement via their connection to a sliding mechanism allowing a side to side action.

Just as it helps, in swimming correctly, to have a slight side to side rolling of the upper body, so too does the little extra thrust provided by the shoving of the torso foward with each stroke help to propel the swimmer foward. While positioned in the cradle, the user can easily give little flip kicks, just like you would in the water to swim fast. Just as in being a great crawl swimmer, most emphasis should be placed on proper upper body motion. One should strive to keep the body streamlined so as to not create any unwanted drag. This swim trainer allows unrestricted use of the hands, arms, shoulders, torso and some freedom of movement for the legs, mostly for comfort.

DETAILED DESCRIPTION OF THE PREFERRED EMBODIMENTS

Figures 1, 2, 3:
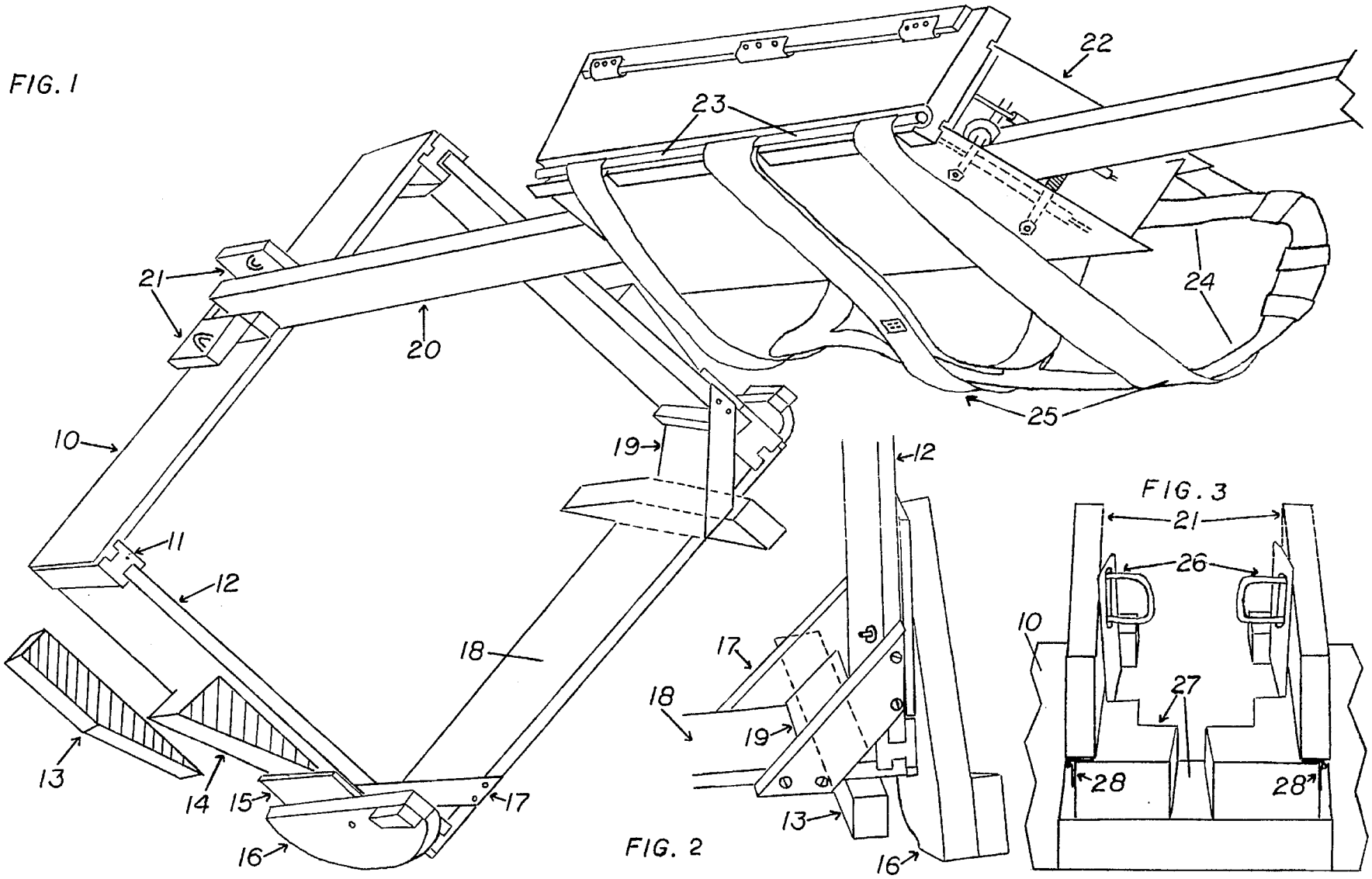
FIG. 1 is a side elevational view of the adjustable height rear support for the long beam from which a movable trolley and hanging cradle roll back and forth.
FIG. 2 is an enlargement of a bottom corner of the adjustable rear support shown in FIG. 1.
FIG. 3 is a view from the rear of the long beam connection support structure shown in FIG. 1.

Reference should now be made to the drawing figures, on which similar or identical elements are given consistent identifying numerals. The reader's attention will be called to the figure best displaying the element although the element may be seen in other figures.

Figures 4, 5, 6:
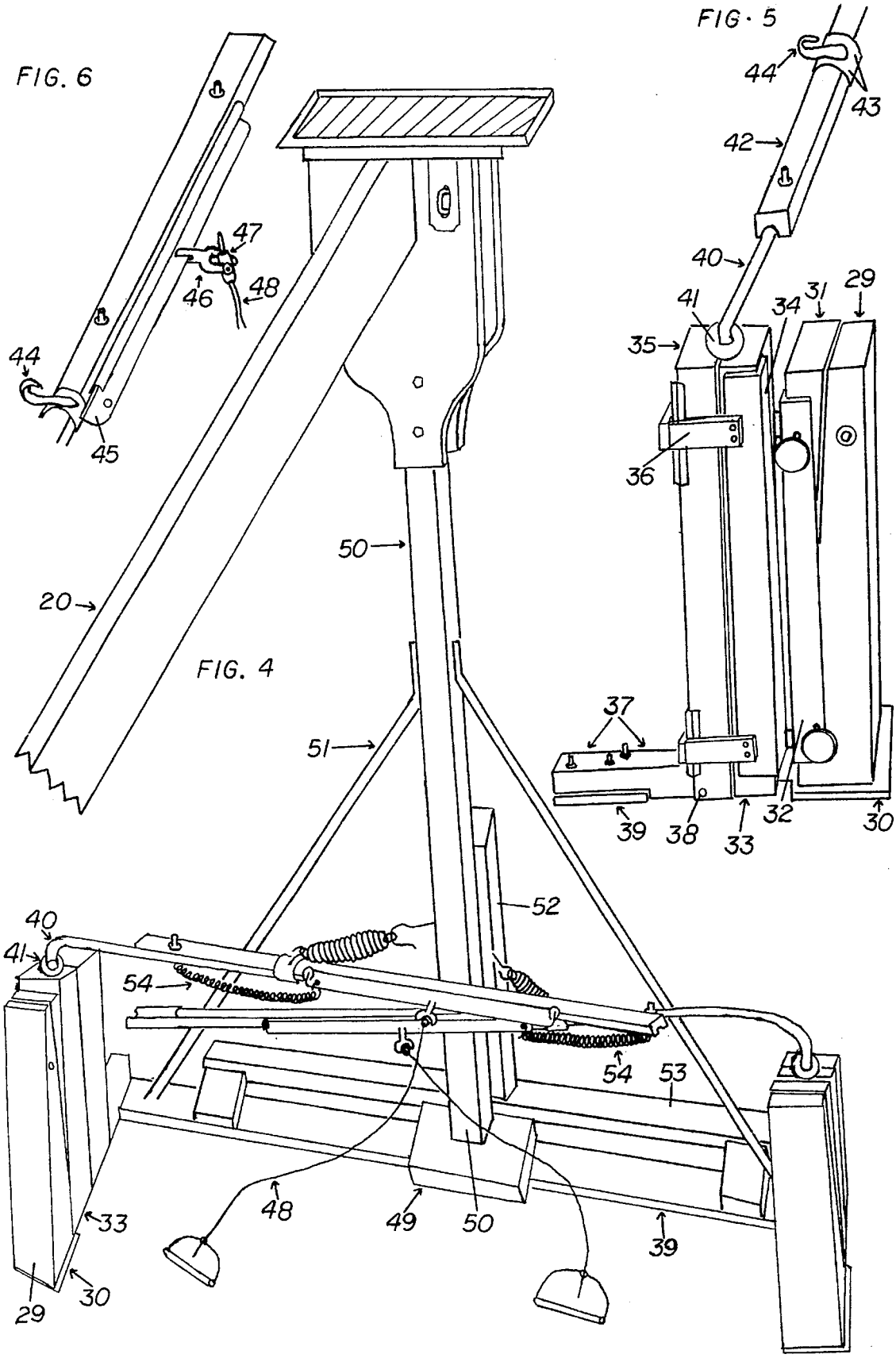
FIG. 4 is an elevated front view (from user's perspective). It features the front support structure for the long beam.
FIG. 5 is a side view of the left (from user's perspective) swinging arm and its arm tower.
FIG. 6 is a continuation of FIG. 5.

In FIG. 1 of the drawings, the long beam 20 has a cross dimension of 2"×4" and a total length of 7 ft. This prototype has the bottom of beam to floor dimension of 39½" at the point of connection with 10. Its bottom of beam to floor dimension; where it meets 50 in FIG. 4 is 42½" giving a 3" slope over those 6 ft. of its total length of 7 ft. FIG. 2 shows one of the base height adjusters (13) as it would be used to make the long beam incline less thus making it easier for the trolley (beam roller housing) 22 to roll back and forth. Item 16 is a base lifter used to facilitate the insertion of 13. When stepped down upon it rotates causing a rounded bottom to push against the floor lifting the base enough to start the insertion of 13. Item 15 is a spacer between 12 and 16. It keeps 16 rotating perpendicular to the floor. Item 11 is a block with deep notches, both top and bottom, used at all four corners. At the top corners it connects and stabilizes items 10 and 12. At the bottom corners it connects 12 and 18. Also, in FIGS. 1 and 2, notice the item marked 19. It is a 90° triangular block used inside all four corners for added strength. The item 17 is used both front and back on the bottom corners. It is another base strengthener. Item 21 can be seen better in FIG. 3; a view from the rear. They are flaps which, via the hinges 28, allow the clasps 26 to move over or out of the way of item 20 as it rests on 10 and against 27. Item 20 can thus be locked in via lock and chain.

Figure 10:
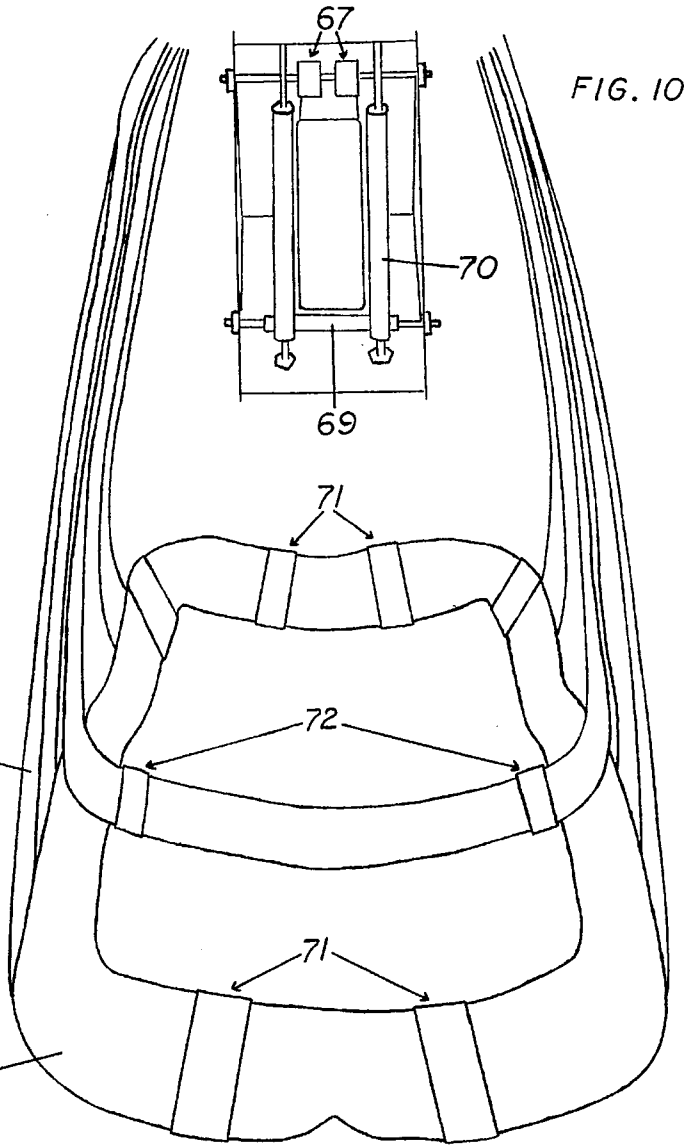
FIG. 10 is a back to front (from user's perspective) view of the suspended cradle.
Figure 9:
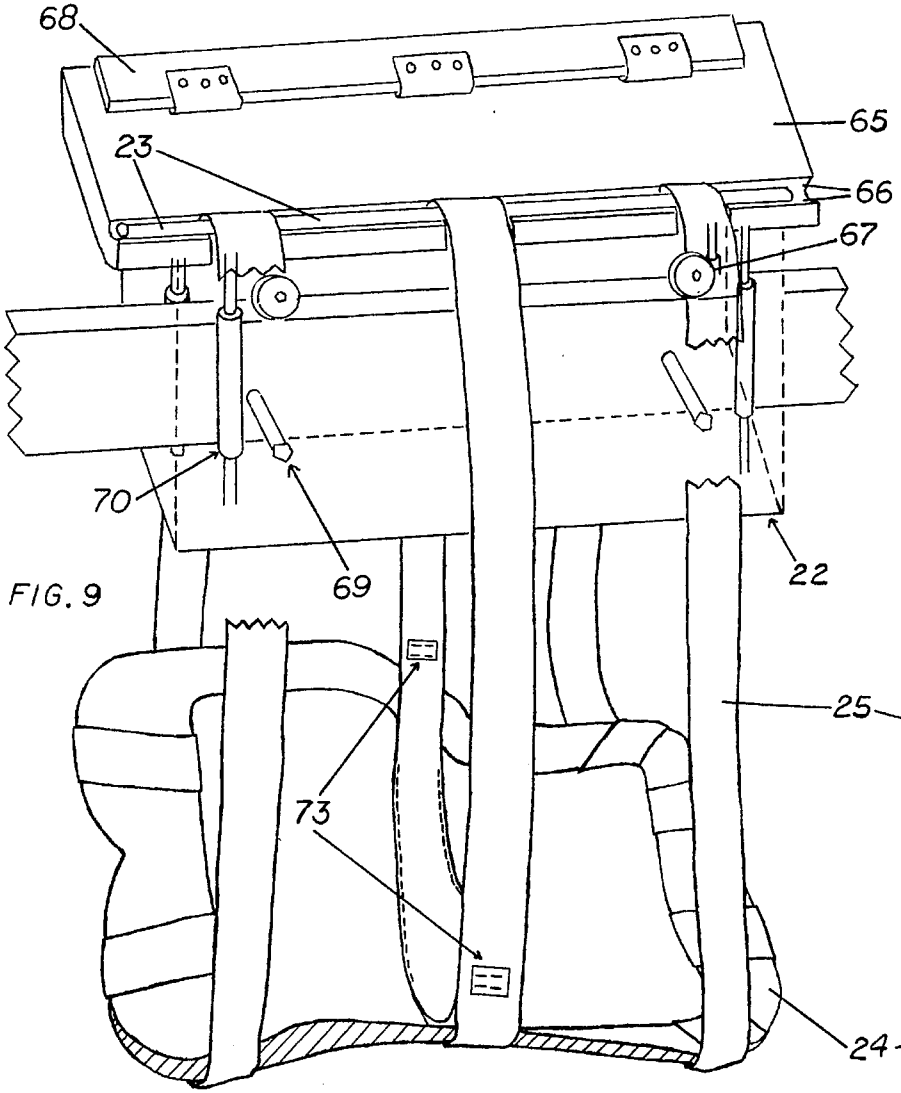
FIG. 9 is a side elevational view of the trolley mechanism and suspended cradle.

The cradle 24 which will be seen more clearly in FIGS. 9 and 10 is connected to the trolley (22) using a very strong but flexable woven fabric 25 such as KEVLAR™ fabric strip material. The cradle for this prototype was fashioned utilizing an orthorpedic back rest plastic frame which very closely conforms to the contours of one's front torso, thereby making it comfortable to be suspended in. Item 23 is a rod resting in a groove on the top edge of 65 FIG. 9. With it a person helping the user can make it easier to get on and off the cradle. Without a helper, the user gets on the cradle by crawling in thru the rear of the beam's base support. He pulls himself in by grasping the front of the cradle 24 and pushes his upper body in with his legs.

Figures 7, 8:
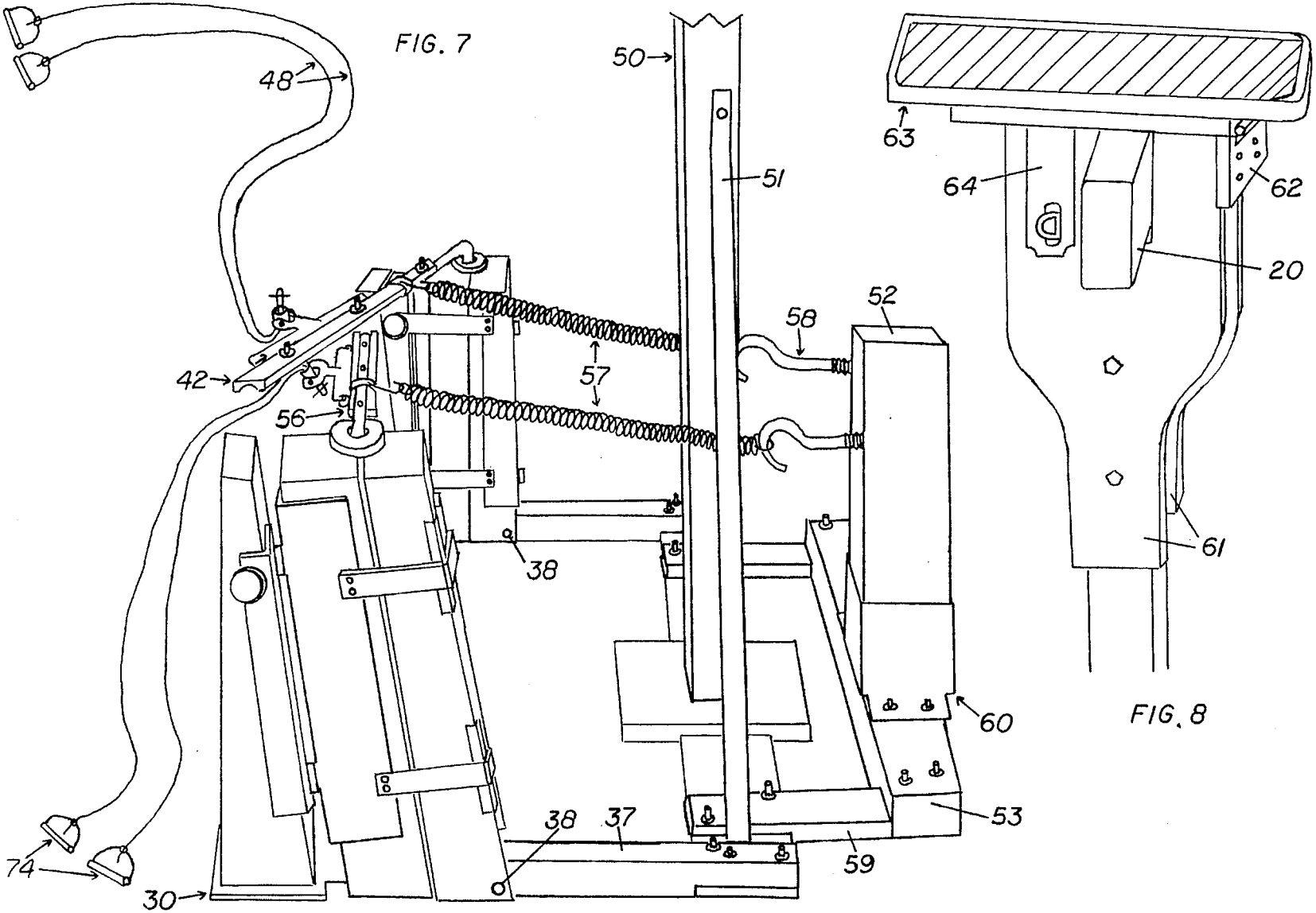
FIG. 7 is a right side view (from user's perspective) of the front base structures. It features the movement of the arms at different heights.
FIG. 8 is a reverse side view of the front base support shown in FIG. 4.

FIG. 4 shows the continuation of 20 to its front support post 50. It is cut with a 94° angle at the top to match the optimum slope for the long beam to both offer a glide of the trolley forward with a push backward by the user's hand on the handhold 74, and a glide backward due to gravity. That 94° angle, in combination with the stretch of the cords 48 and the springs 57, should afford the user a facsimile of the push encountered when in the water. In FIG. 7 there are two rubber stretch cords and handholds attached to each arm just as in the original prototype. The left arm 42 (from user's perspective) is sufficiently taller than the right arm 56 to allow them to move, back and forth, in opposing directions, one above the other, without creating any obstruction to their freedom of movement. The front support post is held firmly in place by two metal braces 51 which are welded to the metal front base member 39; to which the two swinging arm structures and the rear spring upright support structure 52 are also attached. Item 49 in FIG. 4 is notched to fit over 39 while surrounding 50. See FIG. 7. These immobilizations for the upright support post 50, allow no movement. The long beam 20 is held atop 50 with the structure detailed in FIG. 8. Item 61 is a pair (front and back of post) of beam supports which fit snugly against the sides of the long beam allowing for no side to side wobble of the long beam. This prototype machine has a tray 63 covering the tops of 61. Its main function is to lock the long beam in position to prevent tampering with the machine when it is unattended. It is connected to 61 by a hinge located on one side 62, so the long beam can be lifted up and out for moving or storage. This tray has two clasps 64, hanging from it, located to connect to the outward faces of 61 and permit being locked for security.

I will now elaborate upon the function and features found on both the left and the right arm structures. Item 29 is permanently secured to a flat metal plate which is connected on the floor side of 37. It is the main brace limiting the falling forward (toward user) of the arm towers. The arms 42 and 56 are connected to the arm towers by a (90° angle) bent rod 40 which runs their length and is inserted for rotation at point 41. Item 41 is a metal plate with a round hole. It is fixed to only the rearward pivoting upright 35. This is because when the dual uprights (33 and 35) surrounding the inserted rod are pivoted foward, toward user, in the adjustment for optimum angle to the suspended user, the inner side upright 33 has a tendency to become slightly lowered in height. These upright members are cut, on the floor side, to precisely fit over their connecting member 37 which connect to 39 the main base plate. A metal rod or bolt is inserted thru the bottom corner of the rearward upright at 38. It permits just enough pivot of the arm tower, but prevents the lifting free from proper operating position of this connected pair of uprights. The uprights each have a half round hole drilled, at the top, where 40 enters. In FIGS. 5 and 7 can be seen views from the outside, looking in, of the left (5) and right (7) upright arm towers. There are four metal corner piece connectors per upright tower. They are marked 36 in FIG. 5. The corner piece is marked 34. This pair of connected corner pieces per upright tower keeps the pair of upright members (33 and 35) together as if they were one with a hole drilled for 40. The item marked 32 in FIG. 5. is not a corner piece but rather an L beam connected to the connected upright pair. Its function is to offer the securement of the connected upright pair to either 29 or an inserted 31, thus changing the angle of the upright tower. The arm spring 57 FIG. 7 connects to the arm at a hook sleeve 43 and 44 which completely encircles the arm and rod, making for a very durable securing point which will be able to withstand a constant alternating tensioning. The arms each have a side to side sliding device 45 FIG. 6 which, on this prototype, are fashioned out of recessed drawer guides. They allow for a straight ahead tension point connection of the stretch cords to the arms. As the arm is swinging toward the suspended user, this sliding device will move a little toward the end of the arm. When the other arm is being pulled the spring 54 FIG. 4 pulls the sliding device back toward the arm tower; as the arm swings back to rest. Items 46 and 47 (FIG. 6) attach the stretch cord to the sliding device. 47 is a hollow cylindrical tube held by 46 via two indentations on the sides of the tube, which allow small bolts to half penetrate the thick walls of the tube. Through the hollow tube the doubled up mid-section of a conventional rubber stretch cord is pushed and easily held without creating any point for tearing or breakage to occur.

FIG. 7 shows how the alternated height arms connect via spring 57 to clothesline hooks 58 screwed into a hardwood upright positioned several inches ahead of the long beam post 50. This positioning allows for the use of a longer spring and a more straight back direction for the spring action. This front most upright fits into 53 via an oversize mortise and tenon securement. This prototype has an added reinforcement 60 for that upright. It is fashioned by taking a hollow square metal tube, which fits fairly close to 52 and requires a minimum of shim and cutting all four corners for a few inches, so that two flaps can be formed and lifted to lay flat against 53.

FIG. 9 shows the trolley, with suspended cradle, from a side elevational view. Item 68 is a strip atop the trolley cover which lessens the connection stresses imposed upon the flexable woven strips 25. Item 66 is a deep groove on the trolley's cover into which a rod 23 with the woven strip ends wrapped around it can be securely fitted or easily lifted by a person helping the user to get onto or out of the cradle. Item 67 (the top of the beam rollers) were; for this prototype, fashioned from roller skate wheels. They can be seen best in FIG. 10. The side rollers 70 and the bottom 69 are fashioned out of hollow tubes and threaded rods. The top roller 67 are the most important because they absorb most of the downward pressure from the suspended cradle. Item 71 FIG. 10 are positioning strips fashioned from the same material used for the cradle strips 25. These four positioners, after being wrapped over the cradle, are sewn to the long strip which wraps around underneath the cradle. Item 72 is a pair of reinforcements for the doubled up middle of cradle, long strips. Their purpose is to keep the two strips which are sewn together around the cradle's middle member from coming apart. Item 73 are a pair of reinforcements, both inside the strip and outside the doubled strip, sewn completely thru.

Since certain changes may be made in the construction of the above preferred embodiment without departing from the scope of the invention it is intended that all matter contained in the above description or shown on the accompanying (drawing) figures shall be interpreted as illustrative only and not in a limiting sense.

While the foregoing is directed to the preferred embodiment, the scope is determined by the claims which follow.

What is claimed is:

1. A swimming simulative exercise machine comprising:

a) a beam having a head end and a foot end;

b) a beam support means for supporting the beam in an elevated position such that the beam is inclined upwardly in a direction extending from its foot end toward its head end;

c) a roller mechanism which rolls on top of the beam;

d) a user-support means for supporting the user in a substantially horizontal posture, suspended below the beam, the user-support means being secured to the roller mechanism;

e) a first pair of separate arms rotatably mounted to the beam support, each of the first pair being separately rotatable in its separate area transversely about respectively, generally separate vertical axes of the first pair, spaced-apart laterally on opposite sides of the head end of the beam;

f) a second pair of separate handles each thereof being connected to different one of the separate arms by different ones of said third pair of said separate flexible lines; and g) a means for resisting rotation of the arms toward the foot end of the beam and returning the arms toward the head end of the beam.

2. The swimming simulative exercise machine of claim 1, further comprising adjusting means for adjusting the inclination of the beam.

3. The swimming simulative exercise machine of claim 1, wherein the supporting cradle means comprises a cradle adapted to conform to the front of a user's torso.

4. The swimming simulative exercise machine of claim 1, wherein the separate arcs transversed by the arms overlap and one is positioned at a greater height than the other.

5. The swimming simulative exercise machine of claim 1, wherein the resisting and returning means comprises a resilient member mounted generally horizontally between each arm and the beam support means.

6. The swimming simulative exercise machine of claim 1, further comprising adjusting means for adjusting the angle of the generally vertical axes.

7. The swimming simulative exercise machine of claim 1, including angular adjustment means for intermittent adjustment of degree of uprightness substantially along planes substantially parallel to said direction, such that said pair of separate arms are intermittently adjustable substantially along said planes.

8. The swimming simulative exercise machine of claim 1, including a pair of spring-biased slidable arm-connecting means each thereof for connection of one of the separate flexible lines to one of the separate arms, allowing a substantially straight-ahead tension point connection to the connected arm.

* * * * *